US011885533B2

(12) United States Patent
Zhou et al.

(10) Patent No.: US 11,885,533 B2
(45) Date of Patent: Jan. 30, 2024

(54) REFRIGERANT VAPOR COMPRESSION SYSTEM

(71) Applicant: Carrier Corporation, Palm Beach Gardens, FL (US)

(72) Inventors: Jianhua Zhou, Manlius, NY (US); Tobias H. Sienel, Baldwinsville, NY (US); KeonWoo Lee, Manlius, NY (US); Jason D. Scarcella, Cicero, NY (US); Douglas Auyer, Palm Beach Gardens, FL (US); Ping Sue Vang, Liverpool, NY (US); Bruce J. Poplawski, Mattydale, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 375 days.

(21) Appl. No.: 17/253,452

(22) PCT Filed: May 12, 2020

(86) PCT No.: PCT/US2020/032439
§ 371 (c)(1),
(2) Date: Dec. 17, 2020

(87) PCT Pub. No.: WO2020/247153
PCT Pub. Date: Dec. 10, 2020

(65) Prior Publication Data

US 2021/0247109 A1 Aug. 12, 2021

Related U.S. Application Data

(60) Provisional application No. 62/857,928, filed on Jun. 6, 2019.

(51) Int. Cl.
*F25B 1/10* (2006.01)
*F25B 6/04* (2006.01)
(Continued)

(52) U.S. Cl.
CPC ..... *F25B 1/10* (2013.01); *F25B 6/04* (2013.01); *F25B 9/008* (2013.01); *F25B 41/39* (2021.01);
(Continued)

(58) Field of Classification Search
CPC .... F25B 1/10; F25B 6/04; F25B 9/008; F25B 41/39; F25B 2339/047; F25B 2400/072; F25B 2400/13; F25B 2400/23
See application file for complete search history.

(56) References Cited

U.S. PATENT DOCUMENTS 6,568,198 B1 5/2003 Tadano et al.
6,581,408 B1 6/2003 Tadano et al.
(Continued)

FOREIGN PATENT DOCUMENTS

EP 1571337 9/2005
EP 2251622 11/2010
EP 2407734 1/2012

OTHER PUBLICATIONS

Escudier, M., & Atkins, T. (2019). intercooler. In a Dictionary of Mechanical Engineering. : Oxford University Press. Retrieved Jul. 6, 2023, from https://www.oxfordreference.com/view/10.1093/acref/9780198832102.001.0001/acref-9780198832102-e-3197. (Year: 2019).*
(Continued)

*Primary Examiner* — Miguel A Diaz
(74) *Attorney, Agent, or Firm* — Carlson, Gaskey & Olds, P.C.

(57) ABSTRACT

A refrigerant vapor compression system includes a compression device having at least a first compression stage and a second compression stage arranged in series refrigerant flow relationship. A first refrigerant heat rejection heat exchanger is disposed downstream with respect to refrigerant flow of the second compression stage. A first refrigerant intercooler
(Continued)

is disposed intermediate the first compression stage and the second compression stage. The first refrigerant intercooler is disposed downstream of the first refrigerant heat rejection heat exchanger with respect to the flow of the first secondary fluid. An economizer includes a vapor line in fluid communication with a suction inlet to the second compression stage. A second refrigerant heat rejection heat exchanger is disposed intermediate with respect to refrigerant flow of the second compression stage and the first refrigerant heat rejection heat exchanger. A second refrigerant intercooler is disposed intermediate the first compression stage and the second compression.

23 Claims, 6 Drawing Sheets

(51) Int. Cl.
*F25B 41/39* (2021.01)
*F25B 9/00* (2006.01)

(52) U.S. Cl.
CPC ... *F25B 2339/047* (2013.01); *F25B 2400/072* (2013.01); *F25B 2400/13* (2013.01); *F25B 2400/23* (2013.01)

(56) References Cited

U.S. PATENT DOCUMENTS 6,658,888 B2 12/2003 Manohar et al.
8,281,538 B2 10/2012 Waters
8,327,662 B2 12/2012 Yoshimi et al.
8,356,490 B2 1/2013 Yoshimi et al.
8,375,741 B2 2/2013 Taras et al.
8,387,411 B2 3/2013 Fujimoto et al.
8,991,207 B2 3/2015 Takayama et al.
9,249,997 B2 2/2016 Fujimoto et al.
9,557,080 B2 1/2017 Matsuura et al.
9,989,279 B2 6/2018 Huff et al.
2008/0256975 A1 10/2008 Lifson et al.
2010/0058781 A1* 3/2010 Lifson ..... F25B 1/10 62/79
2010/0326100 A1 12/2010 Taras et al.
2011/0023514 A1* 2/2011 Mitra ..... F25B 1/10 62/513
2012/0000237 A1 1/2012 Yamada et al.
2012/0247114 A1 10/2012 Pierson et al.
2012/0312038 A1* 12/2012 Lingelbach ..... F25B 47/022 62/509
2013/0031934 A1 2/2013 Huff et al.
2013/0319036 A1 12/2013 Taras et al.
2014/0053585 A1* 2/2014 Huff ..... F25B 1/10 62/115
2017/0227258 A1 8/2017 Kawano et al.
2018/0313270 A1 11/2018 Jones et al.
2019/0128568 A1 5/2019 Scarcella et al.

OTHER PUBLICATIONS

International Preliminary Report on Patentability for PCT/US2020/032439 dated Dec. 16, 2021.
International Search Report and Written Opinion for International Application No. PCT/US2020/032439 dated Aug. 12, 2020.
Written Opinion for Singapore Application No. 11202012511Q dated Apr. 26, 2023.

* cited by examiner

REFRIGERANT VAPOR COMPRESSION SYSTEM

CROSS-REFERENCE TO RELATED APPLICATIONS

This application claims priority to U.S. Provisional Application No. 62/857,928, which was filed on Jun. 6, 2019 and is incorporated herein by reference.

BACKGROUND

This disclosure relates generally to refrigerant vapor compression systems and, more particularly, to improving the energy efficiency and/or cooling capacity of a refrigerant vapor compression system.

Refrigerant vapor compression systems are commonly used in transport refrigeration systems for refrigerating air supplied to a temperature controlled cargo space of a truck, trailer, container or the like for transporting perishable/frozen items by truck, rail, ship or intermodally.

Traditionally, most of these refrigerant vapor compression systems operate at subcritical refrigerant pressures. However, in recent years greater interest is being shown in "natural" refrigerants, such as carbon dioxide, for use in refrigeration systems instead of HFC refrigerants. Because carbon dioxide has a low critical temperature, most refrigerant vapor compression systems charged with carbon dioxide as the refrigerant are designed for operation in the transcritical pressure regime.

A typical refrigerant vapor compression system includes compression device, a refrigerant heat rejection heat exchanger (functions as a condenser for subcritical operation and as a gas cooler for supercritical operation), a refrigerant heat absorption heat exchanger (functions as an evaporator), and an expansion device disposed upstream, with respect to refrigerant flow, of the refrigerant heat absorption heat exchanger and downstream of the refrigerant heat rejection heat exchanger.

SUMMARY

In one exemplary embodiment, a refrigerant vapor compression system includes a compression device having at least a first compression stage and a second compression stage arranged in series refrigerant flow relationship. A first refrigerant heat rejection heat exchanger is disposed downstream with respect to refrigerant flow of the second compression stage for passing the refrigerant in heat exchange relationship with a flow of a first secondary fluid. A first refrigerant intercooler is disposed intermediate the first compression stage and the second compression stage for passing the refrigerant passing from the first compression stage to the second compression stage in heat exchange relationship with the flow of the first secondary fluid. The first refrigerant intercooler is disposed downstream of the first refrigerant heat rejection heat exchanger with respect to the flow of the first secondary fluid. An economizer includes a vapor line in fluid communication with a suction inlet to the second compression stage. A second refrigerant heat rejection heat exchanger is disposed intermediate with respect to refrigerant flow of the second compression stage and the first refrigerant heat rejection heat exchanger. A second refrigerant intercooler is disposed intermediate the first compression stage and the second compression stage and downstream with respect to refrigerant flow of the vapor line for passing the refrigerant from the first compression stage to the second compression stage in heat exchange relationship with a second secondary fluid.

In a further embodiment of the above, the first refrigerant heat rejecting heat exchanger includes a round tube plat fin heat exchanger or a louver fin mini-channel flat tube heat exchanger.

In a further embodiment of any of the above, the first refrigerant intercooler includes a round tube plat fin heat exchanger or a louver fin mini-channel flat tube heat exchanger.

In a further embodiment of any of the above, the second refrigerant heat rejection heat exchanger includes a brazed plate heat exchanger, a tube-on-tube heat exchanger or a tube-in-tube heat exchanger.

In a further embodiment of any of the above, the second refrigerant intercooler includes a tube-on-tube heat exchanger or a tube-in-tube heat exchanger.

In a further embodiment of any of the above, the first secondary fluid includes air and the second secondary fluid includes a brine.

In a further embodiment of any of the above, a pump is operatively associated with the second refrigerant heat rejection heat exchanger and with the second refrigerant intercooler for moving the flow of the second secondary fluid first through the second refrigerant heat rejection heat exchanger and thence through the second refrigerant intercooler.

In a further embodiment of any of the above, the economizer circuit includes a flash tank economizer disposed between the heat rejection heat exchanger and a heat absorption heat exchanger.

In a further embodiment of any of the above, at least one fan is operatively associated with the first refrigerant heat rejection heat exchanger and with the first refrigerant intercooler for moving the flow of air first through the first refrigerant heat rejection heat exchanger and thence through the first refrigerant intercooler.

In another exemplary embodiment, a refrigerant vapor compression system includes a compression device having at least a first compression stage and a second compression stage arranged in series refrigerant flow relationship. A first refrigerant heat rejecting heat exchanger is disposed downstream with respect to refrigerant flow of the second compression stage for passing the refrigerant in heat exchange relationship with a first secondary fluid. A second refrigerant heat rejecting heat exchanger is disposed upstream with respect to refrigerant flow of the first refrigerant heat rejecting heat exchanger for passing the refrigerant in heat exchange relationship with a second secondary fluid. A first refrigerant intercooler is disposed intermediate the first compression stage and the second compression stage for passing the refrigerant passing from the first compression stage to the second compression stage in heat exchange relationship with the first secondary fluid. A second refrigerant intercooler is disposed intermediate the first compression stage and the second compression stage and upstream with respect to refrigerant flow of the first refrigerant intercooler for passing the refrigerant passing from the first compression stage to the second compression stage in heat exchange relationship with the second secondary fluid. An economizer includes a vapor line in fluid communication with a suction inlet into to the second compression stage.

In a further embodiment of the above, the first refrigerant heat rejecting heat exchanger includes a round tube plate fin heat exchanger or a louver fin mini-channel flat tube heat exchanger.

In a further embodiment of any of the above, the first refrigerant intercooler includes a round tube plate fin heat exchanger or a louver fin mini-channel flat tube heat exchanger.

In a further embodiment of any of the above, the second refrigerant heat rejection heat exchanger includes a brazed plat heat exchanger, a tube-on-tube heat exchanger or a tube-in-tube heat exchanger.

In a further embodiment of any of the above, the second refrigerant intercooler includes a brazed plat heat exchanger, a tube-on-tube heat exchanger or a tube-in-tube heat exchanger.

In a further embodiment of any of the above, the economizer circuit includes a flash tank economizer disposed between the heat rejection heat exchanger and a heat absorption heat exchanger.

In a further embodiment of any of the above, the first secondary fluid includes air and the second secondary fluid includes a brine.

In a further embodiment of any of the above, at least one fan is operatively associated with the first refrigerant heat rejection heat exchanger and with the first refrigerant intercooler for moving the flow of air first through the first refrigerant heat rejection heat exchanger and thence through the first refrigerant intercooler.

In a further embodiment of any of the above, a pump is operatively associated with the second refrigerant heat rejection heat exchanger and with the second refrigerant intercooler for moving the flow of the second secondary fluid first through the second refrigerant heat rejection heat exchanger and thence through the second refrigerant intercooler.

In another exemplary embodiment, a refrigerant vapor compression system includes a compression device having at least a first compression stage and a second compression stage arranged in series refrigerant flow relationship. A first refrigerant heat rejecting heat exchanger is disposed downstream with respect to refrigerant flow of the second compression stage for passing the refrigerant in heat exchange relationship with a first secondary fluid. A second refrigerant heat rejecting heat exchanger is disposed upstream with respect to refrigerant flow of the first refrigerant heat rejecting heat exchanger for passing the refrigerant in heat exchange relationship with a second secondary fluid. A first refrigerant intercooler is disposed intermediate the first compression stage and the second compression stage for passing the refrigerant passing from the first compression stage to the second compression stage in heat exchange relationship with the first secondary fluid. An economizer includes a vapor line in fluid communication with a suction inlet into to the second compression stage.

In another exemplary embodiment, a refrigerant vapor compression system includes a compression device having at least a first compression stage and a second compression stage arranged in series refrigerant flow relationship. A first refrigerant heat rejecting heat exchanger is disposed downstream with respect to refrigerant flow of the second compression stage for passing the refrigerant in heat exchange relationship with a first secondary fluid. A second refrigerant heat rejecting heat exchanger is disposed downstream with respect to refrigerant flow of the first refrigerant heat rejecting heat exchanger for passing the refrigerant in heat exchange relationship with a second secondary fluid. A first refrigerant intercooler is disposed intermediate the first compression stage and the second compression stage for passing the refrigerant passing from the first compression stage to the second compression stage in heat exchange relationship with the first secondary fluid. A second refrigerant intercooler is disposed downstream with respect of refrigerant flow of first refrigerant intercooler for passing the refrigerant passing from the first compression stage to the second compression stage in heat exchange relationship with the second secondary fluid. An economizer includes a vapor line in fluid communication with a suction inlet into to the second compression stage.

DETAILED DESCRIPTION

Figure 1:
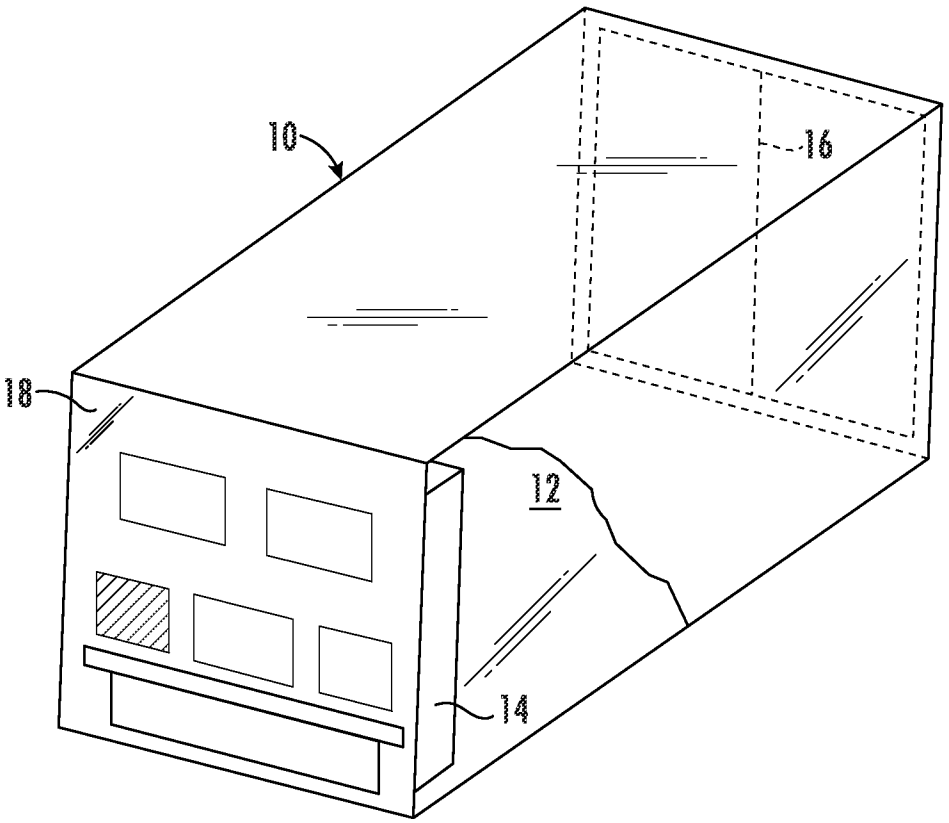
FIG. 1 is perspective view of a refrigerated container equipped with a transport refrigeration system.

FIG. 1 illustrates an example refrigerated container 10 having a temperature controlled cargo space 12 the atmosphere of which is refrigerated by operation of a refrigeration unit 14 associated with the cargo space 12. In the depicted example of the refrigerated container 10, the refrigeration unit 14 is mounted in a wall of the refrigerated container 10, typically in the front wall 18 in conventional practice. However, the refrigeration unit 14 may be mounted in the roof, floor or other walls of the refrigerated container 10. Additionally, the refrigerated container 10 has at least one access door 16 through which perishable goods, such as, for example, fresh or frozen food products, may be loaded into and removed from the cargo space 12 of the refrigerated container 10.

FIGS. 2-6 schematically illustrate various example refrigerant vapor compression systems 20-1 through 20-5 suitable for use in the refrigeration unit 14 for refrigerating air drawn from and supplied back to the temperature controlled cargo space 12. The refrigerant vapor compression systems 20-1 through 20-5 operate in either an air-cooled mode or a water/brine-cooled mode as discussed further below. Although the refrigerant vapor compression systems 20-1 through 20-5 will be described herein in connection with a refrigerated container 10 of the type commonly used for transporting perishable goods by ship, by rail, by land or intermodally, it is to be understood that the refrigerant vapor compression systems 20-1 through 20-5 may also be used in refrigeration units for refrigerating the cargo space of a truck, a trailer or the like for transporting perishable goods. The refrigerant vapor compression systems 20-1 through 20-5 are also suitable for use in conditioning air to be supplied to a climate controlled comfort zone within a residence, office building, hospital, school, restaurant or other facility. The refrigerant vapor compression systems 20-1 through 20-5 could also be employed in refrigerating air supplied to display cases, merchandisers, freezer cabinets, cold rooms or other perishable and frozen product storage areas in commercial establishments.

Figure 2:
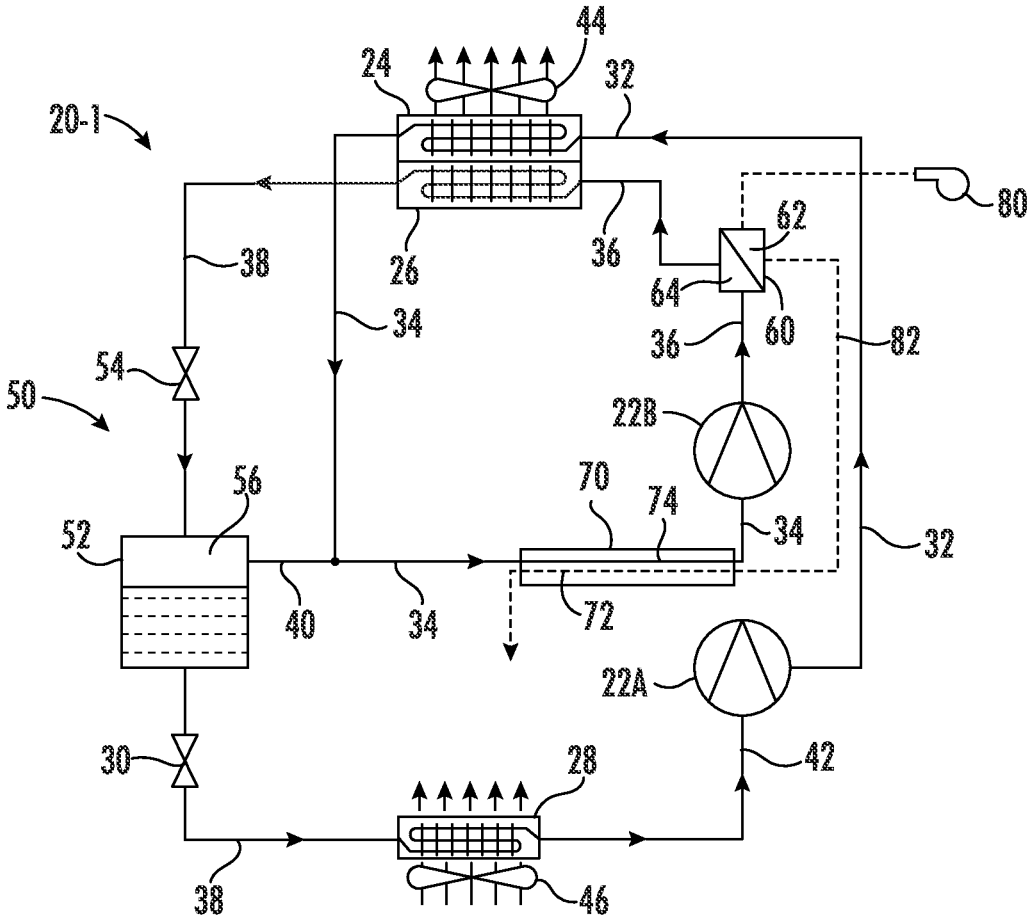
FIG. 2 illustrates a first example refrigerant vapor compression system.

FIG. 2 illustrates an example vapor compression system 20-1. The refrigerant vapor compression system 20-1 includes a compression device having a first compression stage 22A having outlet discharge port fluidly coupled to an inlet on an air-cooled refrigerant intercooler 24 through a refrigerant line 32. The first compression stage 22A compresses the refrigerant vapor from a lower pressure to an intermediate pressure. An outlet of the air-cooled refrigerant intercooler 24 is fluidly coupled to a suction port on a second compression stage 22B of the compression device through a refrigerant line 34. The refrigerant line 34 is also in fluid communication with a second intercooler 70 located fluidly downstream of the air-cooled refrigerant intercooler 24 and upstream of the second compression stage 22B. The second compression stage 22B compresses the fluid from the intermediate pressure to a higher pressure. The first and second compressor stages 22A, 22B may be scroll compressors, screw compressors, reciprocating compressors, rotary compressors or any other type of compressor or a combination of any such compressors.

A discharge port on the second compression stage 22B is fluidly coupled to a refrigerant inlet on a refrigerant heat rejection heat exchanger 26, also referred to herein as a gas cooler, through a refrigerant line 36. The refrigerant line 36 is also in fluid communication with a second refrigerant heat rejection heat exchanger 60 located fluidly downstream of the second compression stage 22B and upstream of the air-cooled refrigerant heat rejection heat exchanger 26. During air-cooled mode, a fan 44 is positioned adjacent the refrigerant heat rejection heat exchanger 26 and the air-cooled refrigerant intercooler 24 for passing secondary fluid (air) over the refrigerant heat rejection heat exchanger 26 and the air-cooled refrigerant intercooler 24. The air-cooled refrigerant intercooler 24 may comprise, for example, a round tube plate fin heat exchanger or a louver fin mini-channel flat tube heat exchanger.

An outlet on the refrigerant heat rejection heat exchanger 26 is fluidly coupled to a refrigerant heat absorption heat exchanger 28, also referred to herein as an evaporator, through a refrigerant line 38. The refrigerant line 38 also includes a primary expansion device 30, such as an electronic expansion valve or a thermostatic expansion valve, operatively associated with the evaporator 28.

The refrigerant heat rejection heat exchanger 26 may comprise a finned tube heat exchanger through which hot, high pressure refrigerant discharged from the second compression stage 22B (i.e. the final compression charge) passes in heat exchange relationship with a secondary fluid, most commonly ambient air drawn through the refrigerant heat rejection heat exchanger 26 by the fan(s) 44. The refrigerant heat rejection heat exchanger 26 may comprise, for example, a round tube plate fin heat exchanger or a louver fin mini-channel flat tube heat exchanger.

The evaporator 28 may also comprise a finned tube coil heat exchanger, such as a fin and round tube heat exchanger coil or a fin and flat mini-channel tube heat exchanger. The evaporator 28 functions as a refrigerant evaporator whether the refrigerant vapor compression system is operating in a transcritical cycle or a subcritical cycle. Before entering the evaporator 28, the refrigerant passing through refrigerant line 38 traverses the primary expansion device 30, such as, for example, an electronic expansion valve or a thermostatic expansion valve, and expands to a lower pressure and a lower temperature to enter the evaporator 28. As two-phase refrigerant traverses the evaporator 28, the refrigerant passes in heat exchange relationship with a heating fluid whereby the refrigerant is evaporated. The low pressure vapor refrigerant leaving the evaporator 28 passes through a refrigerant line 42 to a suction inlet on the first compression stage 22A. The heating fluid may be air drawn by an associated fan(s) 46 from a climate controlled environment, such as a perishable/frozen cargo storage zone associated with a transport refrigeration unit, or a food display or storage area of a commercial establishment, or a building comfort zone associated with an air conditioning system, to be cooled, and generally also dehumidified, and thence returned to a climate controlled environment.

The refrigerant vapor compression system 20-1 further includes an economizer circuit 50 associated with the primary refrigerant circuit. The economizer circuit 50 includes a flash tank economizer 52, an economizer circuit expansion device 54, and a vapor injection line 40 in refrigerant flow communication with an intermediate pressure stage of the compression process through the refrigerant line 34. The economizer circuit expansion device 54 may, for example, be an electronic expansion valve, a thermostatic expansion valve or an adjustable orifice expansion device.

As shown in FIG. 2, the flash tank economizer 52 is disposed in the refrigerant line 38 between the refrigerant heat rejection heat exchanger 26 and the primary expansion device 30. The economizer circuit expansion device 54 is disposed in the refrigerant line 38 upstream of the flash tank economizer 52. The flash tank economizer 52 defines a chamber 56 into which expanded refrigerant having traversed the economizer circuit expansion device 54 enters and separates into a liquid refrigerant portion and a vapor refrigerant portion.

The liquid refrigerant collects in the lower portion of chamber 56 and is metered therefrom through the downstream leg of the refrigerant line 38 by the primary expansion device 30 to flow to the evaporator 28. The vapor refrigerant collects in the upper portion of chamber 62 above the liquid refrigerant and passes therefrom through the vapor injection line 40 for injection of refrigerant vapor into an intermediate stage of the compression process. In the depicted embodiments, the vapor injection line 40 communicates with the refrigerant line 34 downstream of the air-cooled intercooler 24 and upstream of the inlet of the second compression stage 22B. A check valve (not shown) may be disposed in the vapor injection line 40 upstream of its connection with the refrigerant line 34 to prevent backflow through the vapor injection line 40. It is to be understood that when the check valve is fully closed, the system works in non-economized mode.

During operation in brine-cooled mode, the refrigerant vapor compression system 20-1 utilizes a second refrigerant heat rejection heat exchanger 60 and the second intercooler 70 in place of the refrigerant heat rejection heat exchanger 26 and the air-cooled refrigerant intercooler 24, respectively. During operation in the brine-cooled mode, the fan 44 is not operating such that little to no heat transfer occurs in the refrigerant heat rejection heat exchanger 26 and the air-cooled refrigerant intercooler 24. It is to be understood that other liquids, such as for example brines having a glycol or glycol/water mixtures, could be used as the secondary fluid instead of water in the brine-cooled mode.

In the illustrated example, the second refrigeration heat rejection heat exchanger 60 comprises a refrigerant-to-liquid heat exchanger having a secondary liquid pass 62 and a refrigerant pass 64 arranged in heat transfer relationship. The refrigerant pass 64 is disposed in the refrigerant line 36 and forms part of the primary refrigerant circuit. The secondary liquid pass 62 is disposed in a cooling liquid line 82 and forms part of the liquid cooling circuit. The secondary fluid pass 62 and the refrigerant pass 64 of the second refrigerant heat rejection heat exchanger 60 may be arranged in a parallel flow heat exchange relationship or in a counter flow heat exchange relationship, as desired. The second refrigerant heat rejection heat exchanger 60 may be a brazed plate heat exchanger, a tube-in-tube heat exchanger or a tube-on-tube heat exchanger.

The second intercooler 70 comprises a refrigerant-to-liquid heat exchanger having a secondary fluid pass 72 and a refrigerant pass 74 arranged in heat transfer relationship. The refrigerant pass 74 is disposed in refrigerant line 34 that interconnects the air-cooled refrigerant intercooler 24 in refrigerant flow communication with the second compression stage 22B and forms part of the primary refrigerant circuit. The second intercooler 70 is also located downstream of the refrigerant flow from the vapor injection line 40.

In operation, refrigerant passes through the refrigerant pass 74 of the second intercooler 70 in heat exchange relationship with the secondary fluid, for example water, passing through the secondary liquid pass 72 whereby the refrigerant is cooled interstage of the first compression stage 22A and the second compression stage 22B. The secondary fluid pass 72 and the refrigerant pass 74 of the second intercooler 70 are arranged in a counter flow heat exchange relationship. The second intercooler 70 comprises a tube-in-tube heat exchanger or a tube-on-tube heat exchanger. One feature of this configuration is improved packaging in the refrigeration unit 14.

As depicted in FIG. 2, the second intercooler 70 is disposed downstream to the second refrigerant heat rejection heat exchanger 60 with respect to the secondary cooling liquid line 82. The cooling water, or other secondary cooling liquid, is pumped through the secondary cooling liquid line 82 by an associated pump 80 to first flow through the secondary fluid pass 62 in heat exchange relationship with the refrigerant flowing through the refrigerant pass 64 of the second refrigerant heat rejection heat exchanger 60 and then through the secondary liquid pass 72 in heat exchange relationship with the refrigerant flowing through the refrigerant pass 74 of the second intercooler 70. In this arrangement, the refrigerant in the second heat rejection heat exchanger 60 and the second refrigerant intercooler 70 can be cooled with a single-circuit brine fluid flow, instead of two-circuits of brine fluid flow.

Figure 3:
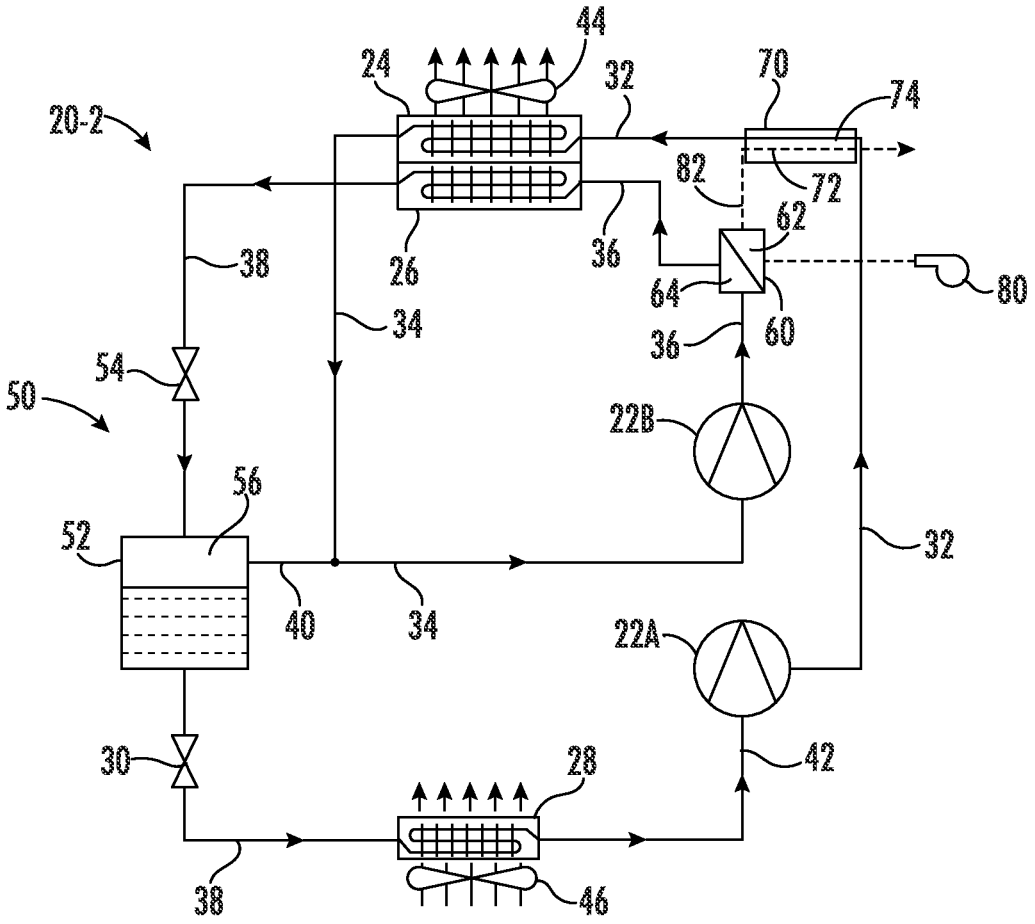
FIG. 3 illustrates a second example refrigerant vapor compression system.

FIG. 3 illustrates a refrigerant vapor compression system 20-2 that is similar to the refrigerant vapor compression system 20-1 except where described below or show in the Figures. In the system 20-2, the second intercooler 70 is located upstream of the air-cooled refrigerant intercooler 24 and associated with the refrigerant line 32 such that heat transfers from refrigerant in the refrigerant pass 74 to the secondary fluid pass 72 prior to the refrigerant reaching the air-cooled refrigerant intercooler 24.

Figure 4:
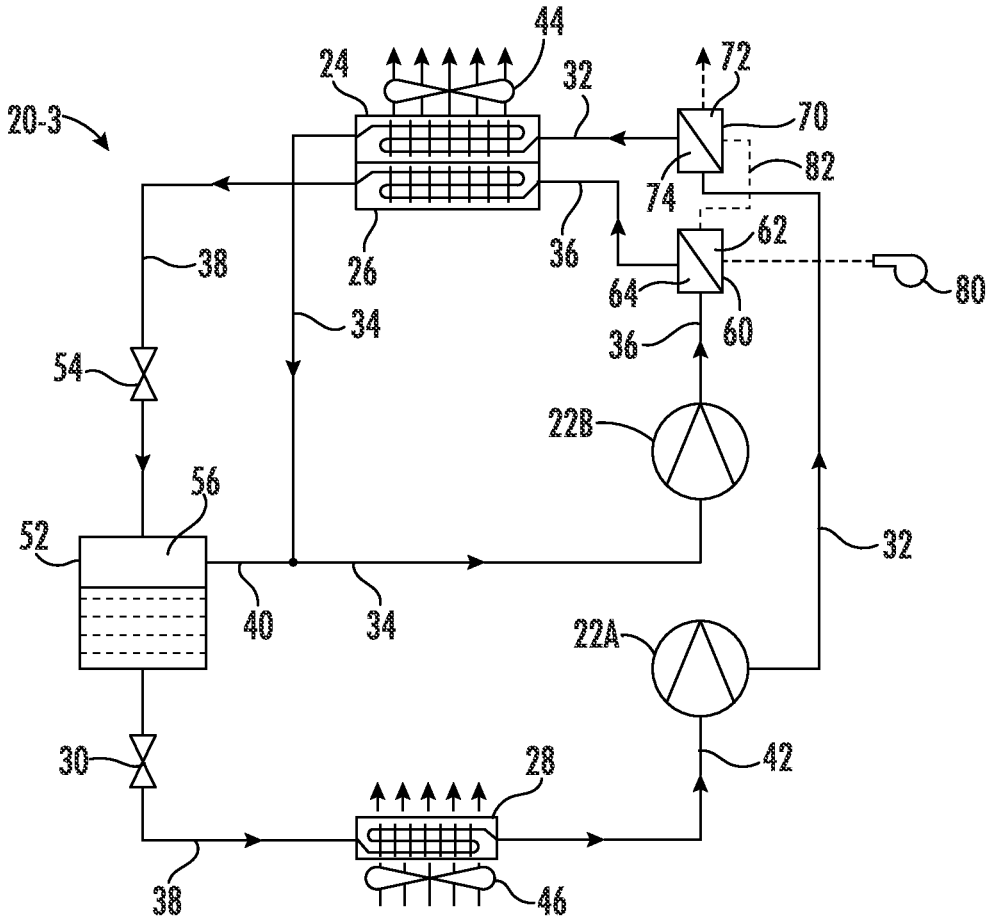
FIG. 4 illustrates a third example refrigerant vapor compression system.

FIG. 4 illustrates a refrigerant vapor compression system 20-3 that is similar to the refrigerant vapor compression system 20-1 except where described below or shown in the Figures. In the system 20-3, the second intercooler 70 is located upstream of the air-cooled refrigerant intercooler 24 and associated with the refrigerant line 32 such that heat transfers from refrigerant in the refrigerant pass 74 to the secondary fluid pass 72 prior to the refrigerant reaching the air-cooled refrigerant intercooler 24. Additionally, the second intercooler 70 is not a tube-on-tube or a tube-in-tube heat exchange in this configuration.

Figure 5:
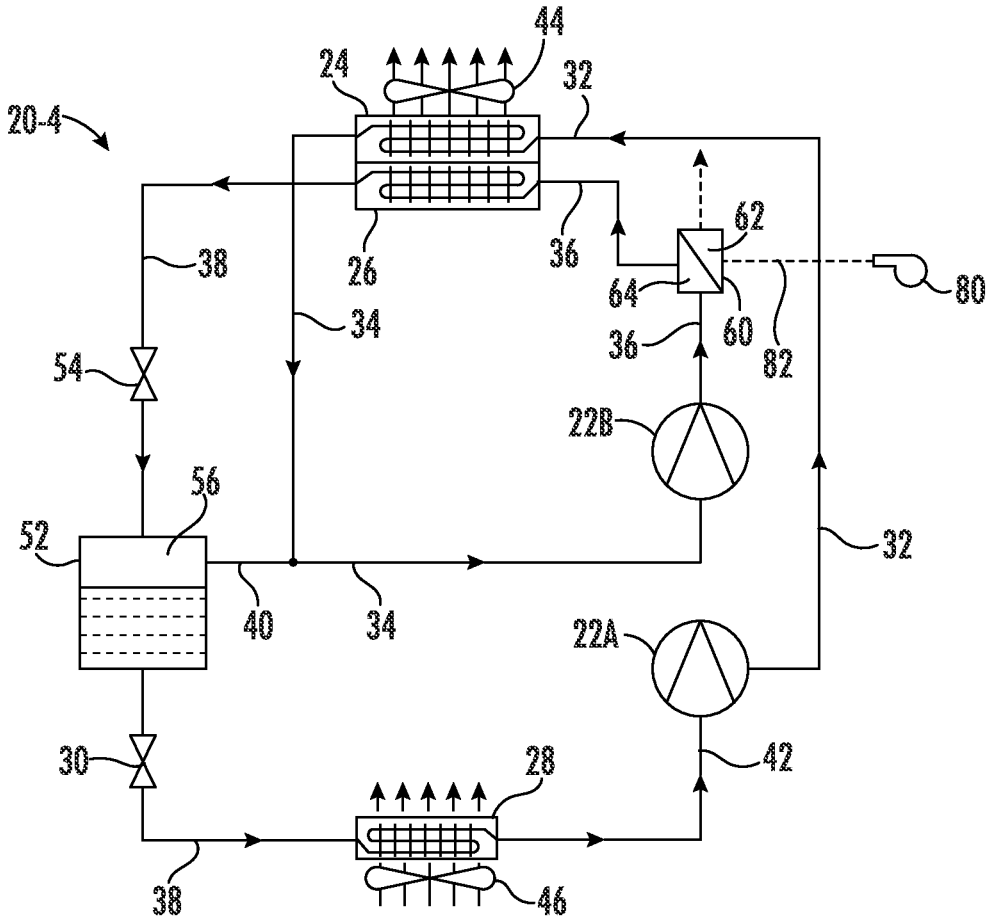
FIG. 5 illustrates a fourth example refrigerant vapor compression system.

FIG. 5 illustrates a refrigerant vapor compression system 20-4 that is similar to the refrigerant vapor compression system 20-3 except where described below or shown in the Figures. In particular, the system 20-4 does not include the second intercooler 70.

Figure 6:
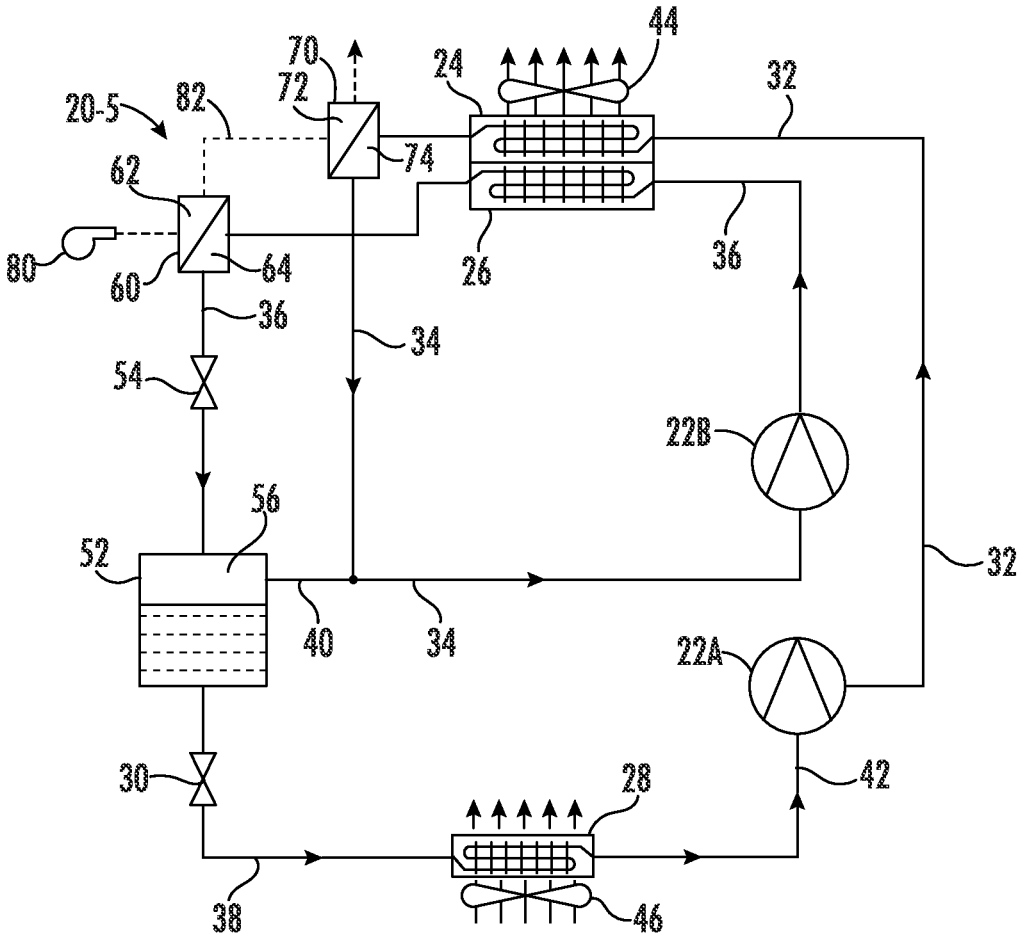
FIG. 6 illustrates a fifth example refrigerant vapor compression system.

FIG. 6 illustrates a refrigerant vapor compression system 20-5 that is similar to the refrigerant vapor compression system 20-3 except where described below or shown in the Figures. In the system 20-5, the second refrigerant heat rejection heat exchanger 60 is located fluidly downstream of the refrigerant heat rejection heat exchanger 26 in the refrigerant line 36 and the second intercooler 70 is located downstream of the air-cooled refrigerant intercooler 24 in the refrigerant line 34.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A refrigerant vapor compression system comprising:

a compression device having at least a first compression stage and a second compression stage arranged in series refrigerant flow relationship;

a first refrigerant heat rejection heat exchanger disposed downstream with respect to refrigerant flow of the second compression stage for passing refrigerant in heat exchange relationship with a flow of a first secondary fluid;

a first refrigerant intercooler disposed intermediate the first compression stage and the second compression stage for passing the refrigerant passing from the first compression stage to the second compression stage in heat exchange relationship with the flow of the first secondary fluid, the first refrigerant intercooler disposed downstream of the first refrigerant heat rejection heat exchanger with respect to the flow of the first secondary fluid, and wherein the first refrigerant intercooler is directly upstream of the second compression stage;

an economizer circuit including a vapor line in fluid communication with a suction inlet to the second compression stage, wherein an outlet from the economizer circuit feeds directly into an inlet to the first refrigerant intercooler;

a second refrigerant heat rejection heat exchanger disposed intermediate with respect to refrigerant flow of the second compression stage and the first refrigerant heat rejection heat exchanger, wherein the second refrigerant heat rejection heat exchanger is directly downstream of the second compression stage and directly upstream of the first refrigerant heat rejection heat exchanger; and a second refrigerant intercooler disposed intermediate the first compression stage and the second compression stage and downstream with respect to refrigerant flow of the vapor line for passing the refrigerant from the first compression stage to the second compression stage in heat exchange relationship with a second secondary fluid, and wherein the second refrigerant intercooler is directly downstream of the first compression stage and directly upstream of the first refrigerant intercooler.

2. The refrigerant vapor compression system of claim 1, wherein the first refrigerant heat rejection heat exchanger comprises a round tube plate fin heat exchanger or a louver fin mini-channel flat tube heat exchanger.

3. The refrigerant vapor compression system of claim 1, wherein the first refrigerant intercooler comprises a round tube plate fin heat exchanger or a louver fin mini-channel flat tube heat exchanger.

4. The refrigerant vapor compression system of claim 1, wherein the second refrigerant heat rejection heat exchanger comprises a brazed plate heat exchanger, a tube-on-tube heat exchanger or a tube-in-tube heat exchanger.

5. The refrigerant vapor compression system of claim 1, wherein the second refrigerant intercooler comprises a tube-on-tube heat exchanger or a tube-in-tube heat exchanger.

6. The refrigerant vapor compression system of claim 1 wherein the first secondary fluid comprises air and the second secondary fluid comprises a brine.

7. The refrigerant vapor compression system of claim 1, further comprising a pump operatively associated with the second refrigerant heat rejection heat exchanger and with the second refrigerant intercooler for moving the flow of the second secondary fluid first through the second refrigerant heat rejection heat exchanger and thence through the second refrigerant intercooler.

8. The refrigerant vapor compression system of claim 1, wherein the economizer circuit includes a flash tank economizer disposed between the first refrigerant heat rejection heat exchanger and a heat absorption heat exchanger.

9. The refrigerant vapor compression system as recited in claim 1, further comprising at least one fan operatively associated with the first refrigerant heat rejection heat exchanger and with the first refrigerant intercooler for moving the first secondary fluid first through the first refrigerant heat rejection heat exchanger and thence through the first refrigerant intercooler.

10. The refrigerant vapor compression system of claim 1, wherein the first refrigerant intercooler is directly upstream of the suction inlet of the second compression stage and directly downstream of the economizer circuit.

11. A refrigerant vapor compression system comprising:

a compression device having at least a first compression stage and a second compression stage arranged in series refrigerant flow relationship;

a first refrigerant heat rejection heat exchanger disposed downstream with respect to refrigerant flow of the second compression stage for passing refrigerant in heat exchange relationship with a first secondary fluid;

a second refrigerant heat rejection heat exchanger disposed upstream with respect to refrigerant flow of the first refrigerant heat rejection heat exchanger for passing the refrigerant in heat exchange relationship with a second secondary fluid, and wherein the second refrigerant heat rejection heat exchanger is directly downstream of the second compression stage and directly upstream of the first refrigerant heat rejection heat exchanger;

a first refrigerant intercooler disposed intermediate the first compression stage and the second compression stage for passing the refrigerant passing from the first compression stage to the second compression stage in heat exchange relationship with the first secondary fluid;

a second refrigerant intercooler disposed intermediate the first compression stage and the second compression stage and directly upstream with respect to refrigerant flow of the first refrigerant intercooler for passing the refrigerant passing from the first compression stage to the second compression stage in heat exchange relationship with the second secondary fluid, and wherein the second refrigerant intercooler is directly downstream of the first compression stage; and an economizer circuit including a vapor line in fluid communication with a suction inlet into to the second compression stage, and wherein an outlet from the first refrigerant heat rejection heat exchanger feeds directly into the economizer circuit.

12. The refrigerant vapor compression system of claim 11, wherein the first refrigerant heat rejection heat exchanger comprises a round tube plate fin heat exchanger or a louver fin mini-channel flat tube heat exchanger.

13. The refrigerant vapor compression system of claim 11, wherein the first refrigerant intercooler comprises a round tube plate fin heat exchanger or a louver fin mini-channel flat tube heat exchanger.

14. The refrigerant vapor compression system of claim 11, wherein the second refrigerant heat rejection heat exchanger comprises a brazed plate heat exchanger, a tube-on-tube heat exchanger or a tube-in-tube heat exchanger.

15. The refrigerant vapor compression system of claim 11, wherein the second refrigerant intercooler comprises a brazed plate heat exchanger, a tube-on-tube heat exchanger or a tube-in-tube heat exchanger.

16. The refrigerant vapor compression system of claim 11, wherein the economizer circuit includes a flash tank economizer disposed between the first refrigerant heat rejection heat exchanger and a heat absorption heat exchanger.

17. The refrigerant vapor compression system of claim 11, wherein the first secondary fluid comprises air and the second secondary fluid comprises a brine.

18. The refrigerant vapor compression system as recited in claim 11, further comprising at least one fan operatively associated with the first refrigerant heat rejection heat exchanger and with the first refrigerant intercooler for moving the first secondary fluid first through the first refrigerant heat rejection heat exchanger and thence through the first refrigerant intercooler.

19. The refrigerant vapor compression system of claim 11, further comprising a pump operatively associated with the second refrigerant heat rejection heat exchanger and with the second refrigerant intercooler for moving the flow of the second secondary fluid first through the second refrigerant heat rejection heat exchanger and thence through the second refrigerant intercooler.

20. The refrigerant vapor compression system of claim 1, wherein the second refrigerant heat rejection heat exchanger has a liquid pass and a refrigerant pass arranged in a heat transfer relationship, wherein an outlet of the second compression stage is in direct flow communication with an inlet to the refrigerant pass, and wherein an outlet from the refrigerant pass is in direct flow communication with an inlet to the first refrigerant heat rejection heat exchanger.

21. A refrigerant vapor compression system comprising:

a compression device having at least a first compression stage and a second compression stage arranged in series refrigerant flow relationship;

a first refrigerant heat rejection heat exchanger disposed downstream with respect to refrigerant flow of the second compression stage for passing refrigerant in heat exchange relationship with a first secondary fluid;

a second refrigerant heat rejection heat exchanger disposed upstream with respect to refrigerant flow of the first refrigerant heat rejection heat exchanger for passing the refrigerant in heat exchange relationship with a second secondary fluid, and wherein the second refrigerant heat rejection heat exchanger is directly downstream of the second compression stage and directly upstream of the first refrigerant heat rejection heat exchanger;

a first refrigerant intercooler disposed intermediate the first compression stage and the second compression stage for passing the refrigerant passing from the first compression stage to the second compression stage in heat exchange relationship with the first secondary fluid, wherein the first refrigerant intercooler is directly downstream of the first compression stage and directly upstream of the second compression stage; and an economizer circuit including a vapor line in fluid communication with a suction inlet into to the second compression stage, and wherein an outlet from the first refrigerant heat rejection heat exchanger feeds directly into the economizer circuit.

22. The refrigerant vapor compression system of claim 21, wherein the second refrigerant heat rejection heat exchanger has a liquid pass and a refrigerant pass, wherein an outlet of the second compression stage is in direct flow communication with an inlet to the refrigerant pass, and wherein an outlet from the refrigerant pass is in direct flow communication with an inlet to the first refrigerant heat rejection heat exchanger.

23. A refrigerant vapor compression system comprising:

a compression device having at least a first compression stage and a second compression stage arranged in series refrigerant flow relationship;

a first refrigerant heat rejection heat exchanger disposed downstream with respect to refrigerant flow of the second compression stage for passing refrigerant in heat exchange relationship with a first secondary fluid;

a second refrigerant heat rejection heat exchanger disposed upstream with respect to refrigerant flow of the first refrigerant heat rejection heat exchanger for passing the refrigerant in heat exchange relationship with a second secondary fluid, and wherein the second refrigerant heat rejection heat exchanger is directly downstream of the second compression stage and directly upstream of the first refrigerant heat rejection heat exchanger;

a first refrigerant intercooler disposed intermediate the first compression stage and the second compression stage for passing the refrigerant passing from the first compression stage to the second compression stage in heat exchange relationship with the first secondary fluid;

a second refrigerant intercooler disposed upstream with respect to refrigerant flow of the first refrigerant intercooler for passing the refrigerant passing from the first compression stage to the second compression stage in heat exchange relationship with the second secondary fluid, and wherein the second refrigerant intercooler has a fluid pass and a refrigerant pass arranged in a heat transfer relationship, and wherein an outlet from the first compression stage is in direct flow communication with an inlet to the refrigerant pass, and wherein an outlet from the refrigerant pass is in direct flow communication with an inlet to the first refrigerant intercooler; and an economizer circuit including a vapor line in fluid communication with a suction inlet into to the second compression stage, and wherein an outlet from the first refrigerant heat rejection heat exchanger feeds directly into the economizer circuit.

* * * * *